US005937809A

United States Patent [19]

Pierik et al.

[11] Patent Number: 5,937,809

[45] Date of Patent: Aug. 17, 1999

[54] VARIABLE VALVE TIMING MECHANISMS

[75] Inventors: Ronald Jay Pierik, Rochester; Jeffrey David Rohe, Caledonia, both of N.Y.

[73] Assignee: General Motors Corporation, Detroit, Mich.

[21] Appl. No.: 09/034,564

[22] Filed: Mar. 3, 1998

Related U.S. Application Data

[60] Provisional application No. 60/041,284, Mar. 20, 1997.

[51] Int. Cl.[6] ..... F01L 13/00

[52] U.S. Cl. ..... 123/90.16; 123/90.17

[58] Field of Search ..... 123/90.15, 90.16, 123/90.17, 90.31

[56] References Cited

U.S. PATENT DOCUMENTS

| | | | |
|---|---|---|---|
| 4,261,307 | 4/1981 | Oldberg | 123/90.15 |
| 4,572,118 | 2/1986 | Baguena | 123/90.16 |
| 4,580,533 | 4/1986 | Oda et al. | 123/90.16 |
| 5,107,802 | 4/1992 | Yagi et al. | 123/90.15 |
| 5,189,998 | 3/1993 | Hara | 123/90.16 |
| 5,205,247 | 4/1993 | Hoffman | 123/90.16 |
| 5,253,620 | 10/1993 | Dohn et al. | 123/90.16 |
| 5,501,186 | 3/1996 | Yamada et al. | 123/90.16 |
| 5,732,669 | 3/1998 | Fischer et al. | 123/90.16 |
| 5,787,849 | 8/1998 | Mitchell | 123/90.16 |

FOREIGN PATENT DOCUMENTS

| | | |
|---|---|---|
| 686756 A1 | 12/1995 | European Pat. Off. . |
| 2700580 A1 | 7/1994 | France . |
| 4300684 A1 | 7/1994 | Germany . |
| 7324610 | 12/1995 | Japan . |
| 1799075 | 5/1996 | U.S.S.R. . |
| 2214567 | 9/1989 | United Kingdom . |
| WO9413935 A1 | 6/1994 | WIPO . |
| WO 95/16108 | 6/1995 | WIPO . |

*Primary Examiner*—Weilun Lo

*Attorney, Agent, or Firm*—Karl F. Barr, Jr.; Vince A. Cichosz

[57] ABSTRACT

Crank rocker variable valve timing (VVT) mechanisms are disclosed which are relatively compact and are applicable for operating individual or multiple valves. In an exemplary embodiment, an engine valve is driven by an oscillatable rocker cam that is actuated by a linkage driven by a rotary eccentric, preferably a rotary cam. The linkage is pivoted on a control member that is in turn pivotable about the axis of the rotary cam and angularly adjustable to vary the orientation of the rocker cam and thereby vary the valve lift and timing. The rotary cam may be carried on a camshaft. The oscillatable cam is pivoted on the rotational axis of the rotary cam. For some applications the rotary cam and follower could be replaced by a crank or eccentric driving a rocker arm. Numerous other variations in the arrangements are also possible.

14 Claims, 11 Drawing Sheets

VARIABLE VALVE TIMING MECHANISMS

This application claims the benefit of U.S. Provisional application 60/041,284, filed Mar. 20, 1997.

TECHNICAL FIELD

This invention relates to variable valve timing mechanisms and, more particularly, to valve actuating mechanisms for varying the lift and timing of engine valves.

BACKGROUND OF THE INVENTION

It is known in the automotive engine art that the provision of variable valve timing (VVT) and/or variable valve lift valve actuating mechanisms has the capability for potentially improving the system performance of an engine by reducing pump work and valve train friction, controlling engine load and internal exhaust dilution, improving charge preparation, increasing peak power and enabling the use of various transient operation control strategies not otherwise available. A myriad of VVT mechanisms have been disclosed in the prior art but the use of such mechanisms has been relatively limited. This has been due in part to their size, cost and/or operating limitations which have limited their practicality and potential value in real production engine applications.

SUMMARY OF THE INVENTION

The present invention provides variable valve timing (VVT) mechanisms which are relatively compact, and are applicable for operating individual or multiple valves. In accordance with the invention, an engine valve is driven by an oscillating rocker cam that is actuated by a linkage driven by a rotary eccentric, preferably a rotary cam. The linkage is pivoted on a control member that is, in turn, pivotable about the axis of the rotary cam and angularly adjustable to vary the orientation of the rocker cam and thereby vary the valve lift and timing. The rotary cam may be carried on a camshaft. The oscillating cam is pivoted on the axis of the rotary cam.

For some applications, the rotary cam and follower could be replaced by a crank or eccentric driving a rocker arm. Numerous other variations in the arrangements are also possible.

These and other features and advantages of the invention will be more fully understood from the following description of certain exemplary embodiments of the invention taken together with the accompanying drawings.

DESCRIPTION OF THE PREFERRED EMBODIMENTS

Figure 1:
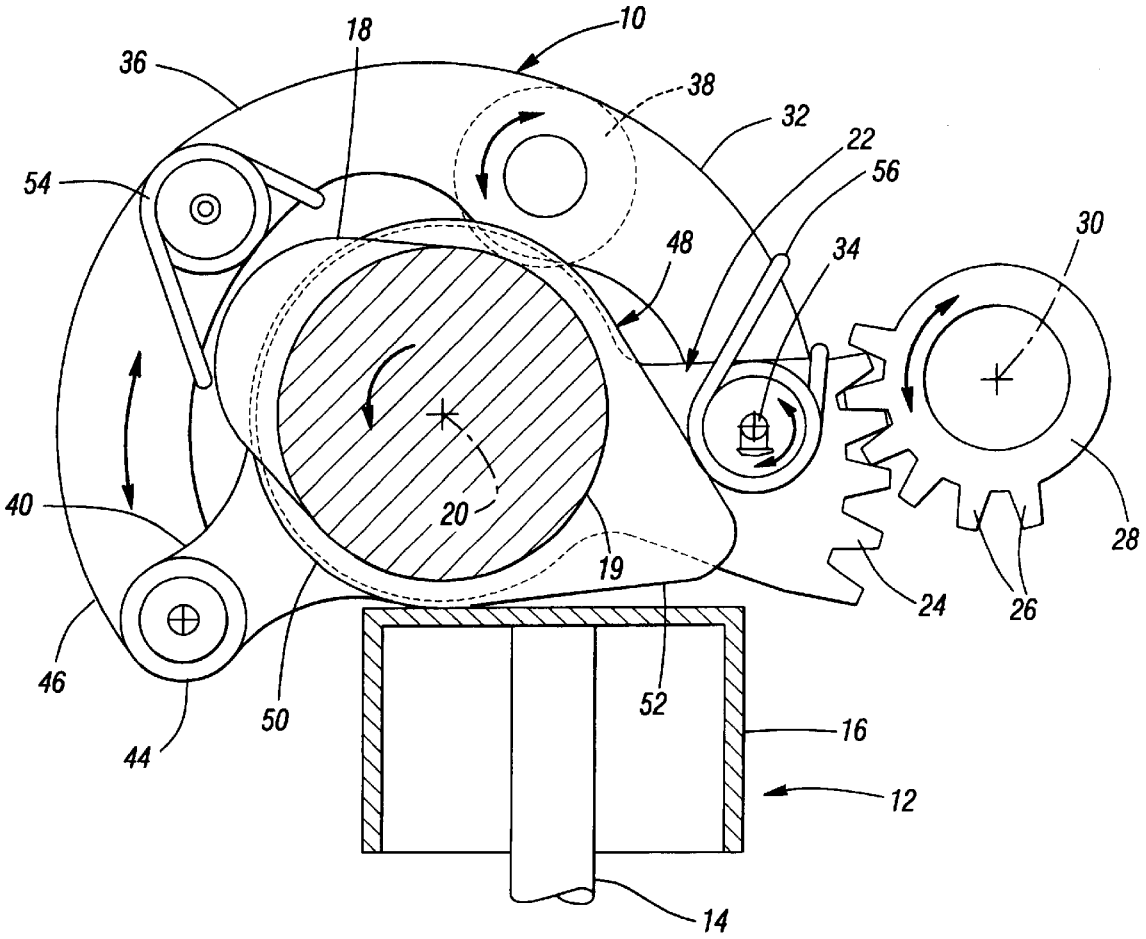
FIG. 1 is a semi-schematic end view of an exemplary embodiment of a VVT mechanism according to the invention directly actuating a single engine valve.

Referring first to FIG. 1 of the drawings in detail, numeral 10 generally indicates a first exemplary embodiment of variable valve timing (VVT) mechanism which is operable to vary valve timing and lift in an operating engine 12 having a valve 14 actuated through a direct acting follower 16. VVT mechanism 10 includes a rotary cam 18 carried, for example, on a camshaft 19 and rotatable on a rotational primary axis 20. Cam 18 is a form of eccentric included in a class of drives including cranks and other circular eccentric elements which could be substituted for the cam if desired in appropriate applications.

Mechanism 10 further includes a control member 22 in the form of a carrier link or lever which is pivotable about the primary axis 20. Member 22 is externally drivable by teeth 24 that are engaged by mating teeth 26 formed on a control gear 28 that may be oscillated about an axis 30 parallel to the primary axis. If desired, the control gear 28 could be replaced by a cam or a linkage for driving the control member 22. A primary lever or rocker 32 is pivotally connected at one end with member 22 at a pivot axis 34 spaced from the primary axis 20. Rocker 32 has a distal end 36 and an eccentric follower 38 in the form of a roller or other suitable means engaging the cam 18 and acting as a cam follower.

A secondary lever 40 has one end mounted on and pivotable about the primary axis 20. Secondary lever 40 has a distal end 44 spaced from the axis 20 and operatively connected with the distal end 36 of the rocker 32. This operative connection is made by a link 46 pivotally interconnecting the two distal ends 44, 36, although other means of drivingly interconnecting the rocker 32 and lever 40 could be used if desired.

Secondary lever 40 also includes at said one end an oscillating cam 48 having a base circle portion 50 centered on the primary axis 20 and a valve lift portion 52 extending eccentrically outward from the base circle portion. The cam 48 engages the cam follower 16 for actuating the follower in a reciprocating motion directly acting upon the valve 14 for opening and closing the valve.

In operation of the mechanism 10 shown in FIG. 1, the rotary cam 18 is driven in timed relation with the engine crankshaft by any suitable means, such as a camshaft drive, not shown. The control member 22 is positioned in a predetermined orientation which is angularly adjustable to vary valve lift and timing but remains fixed when no change is desired. When the eccentric, or raised portion, of the cam 18 engages the roller follower 38, the rocker 32 is pivoted outward (up) about the pivot axis 34 located on the control member 22. This raises link 46, causing the secondary lever 40 to rotate clockwise about the primary axis 20 and slide or rock the oscillating cam 48 against the direct acting follower 16.

If the control member 22 is in a first position as shown, the clockwise lever motion causes the valve lift portion 52 of the oscillating cam 48 to actuate the follower 16 downward, opening the valve 14 to its full open position. Upon further rotation of the rotary cam 18, the roller follower 38 rides back down the cam 18 to its base circle, allowing torsional springs 54 and/or 56 to return the mechanism 10 back to the initial first position shown. This pivots the secondary lever 40 with oscillating cam 48 counterclockwise, allowing the valve 14 to close as the follower 16 is again engaged by the oscillating cam base circle portion 50.

To reduce valve lift and valve open time, the control member 22 is rotated counterclockwise, by rotation of the control gear 28, toward a second position, not shown, of the control member, angularly displaced from the first position. In the second position, the oscillating motion of the cam 48 merely slides its base circle portion 50 against the follower 16 so that the valve remains closed when the mechanism 10 oscillates the cam 48. In intermediate positions of the control member 22, the valve will be partially opened for a lesser period of time than with the full opening movement, the proportion of full valve opening depending upon the closeness of the control member to the first (full opening) position.

FIGS. 2–5 of the drawings show an alternative second embodiment of VVT mechanism 110 having components indicated by 100 series numerals, with similar elements having common suffix numerals. The second mechanism 110 is functionally very similar to the first mechanism 10 although different in appearance and more compact in size.

Figure 2:
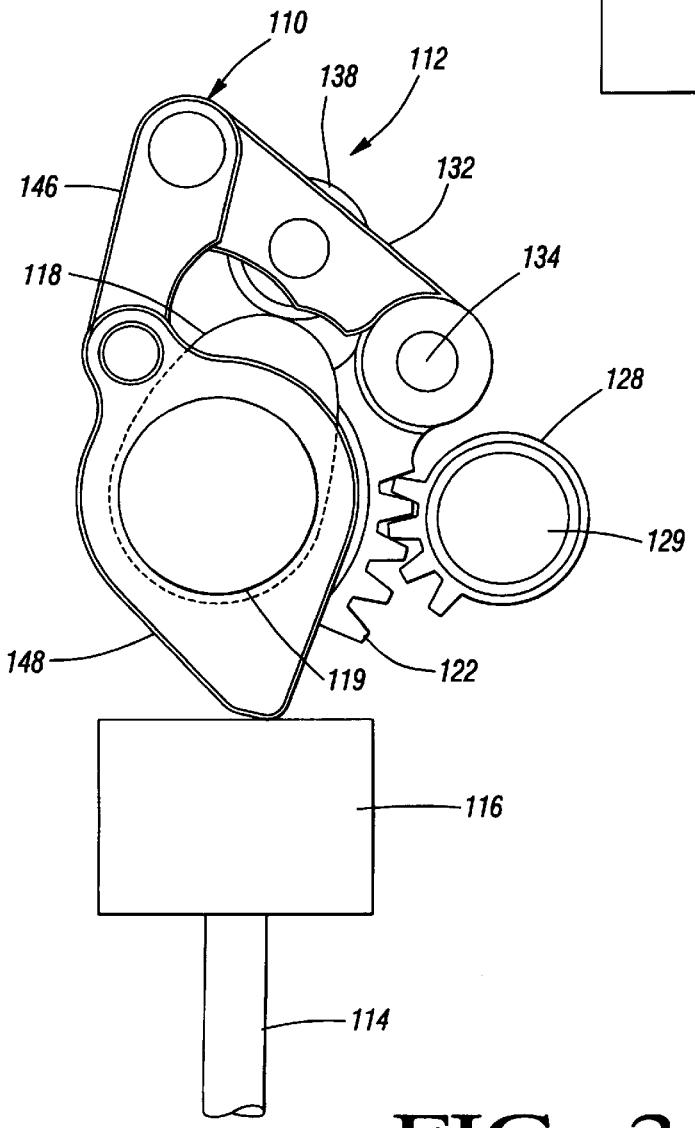

Mechanism 110 is made to operate dual valves 114 in an engine 112 through direct acting followers or valve lifters 116. Dual control members 122 are positioned by dual control gears 128 mounted on a common control shaft 129. As before, the control members 122 carry the pivot axis 134 for a primary lever or rocker 132. A single rotary cam 118 carried on a camshaft 119 drives a single roller follower 138 carried by the rocker 132 to lift dual links 146 that oscillate dual cams 148. FIG. 2 shows the mechanism 110 with the dual valves 114 fully open while FIGS. 3–5 illustrate the valve closed position.

Figure 3:
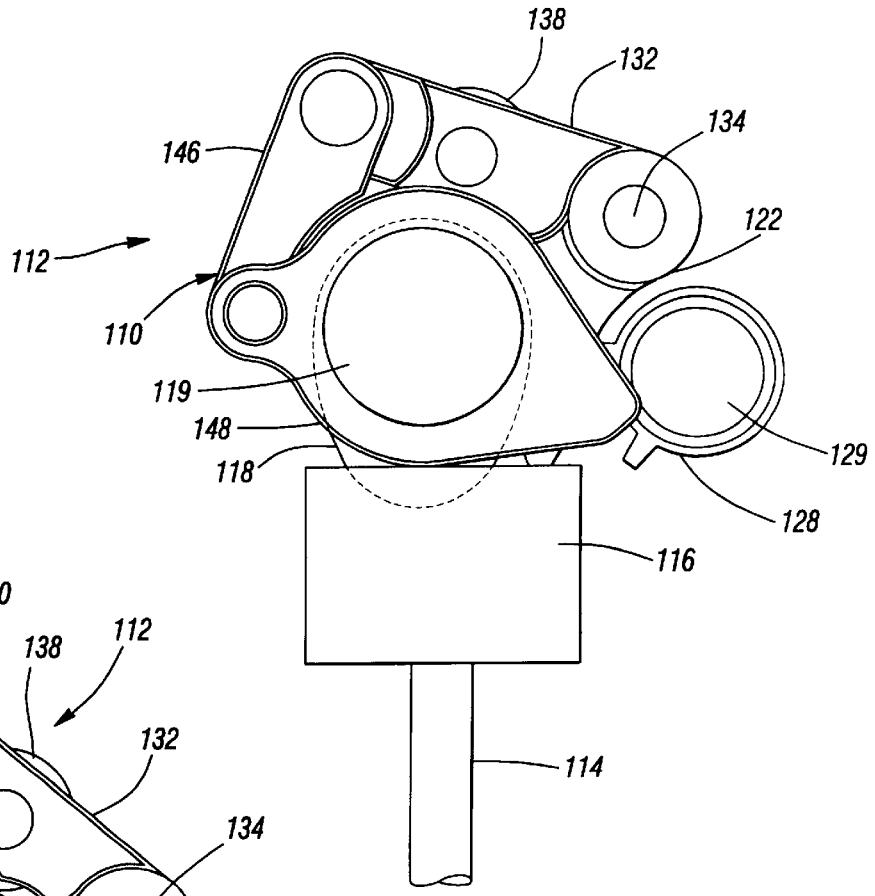
FIGS. 2 and 3 are views similar to FIG. 1 but showing differing operating positions of a modified similarly operating mechanism.
Figure 4:
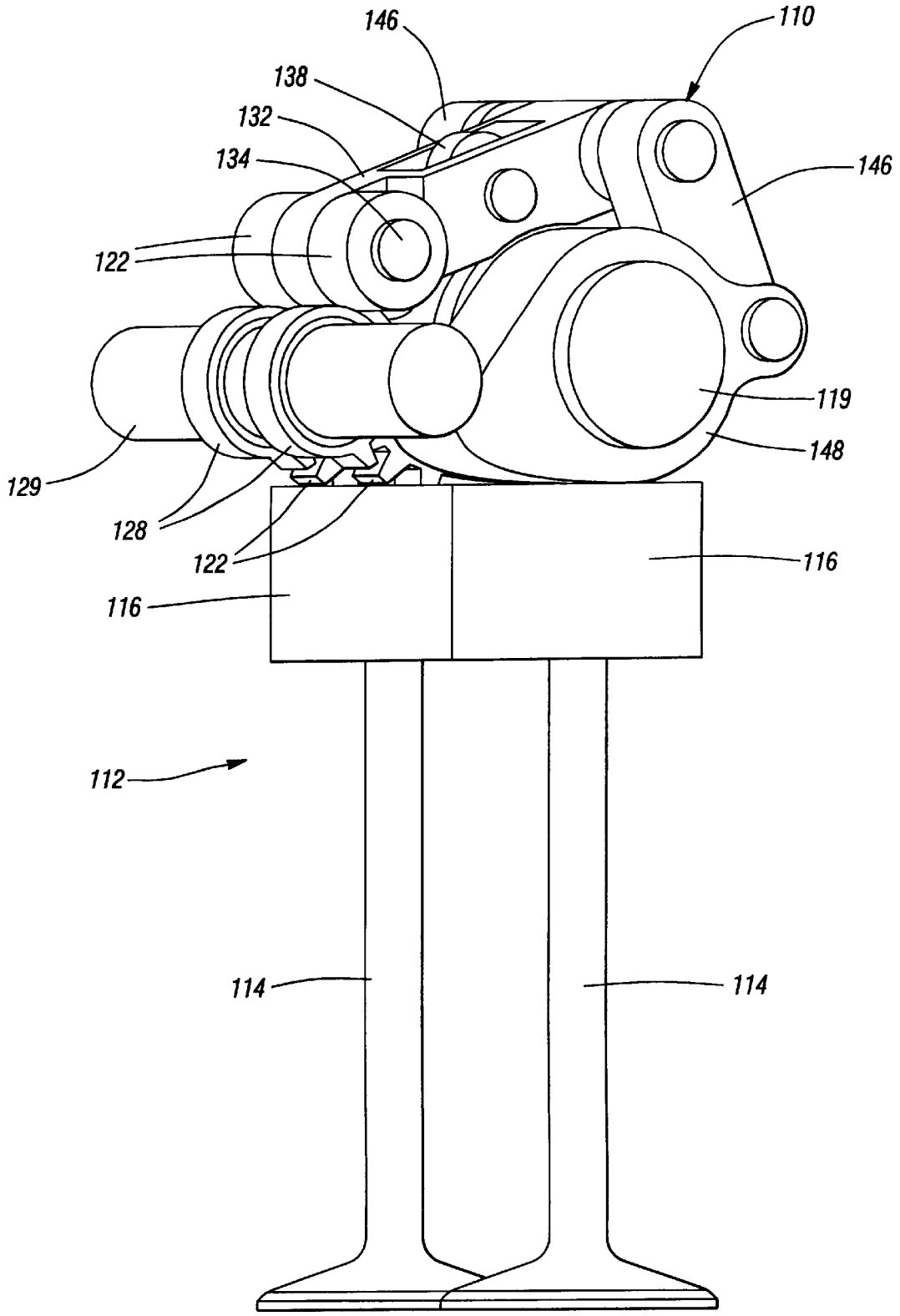
FIGS. 4 and 5 are isometric front and rear views of the mechanism of FIG. 3.
Figure 5:
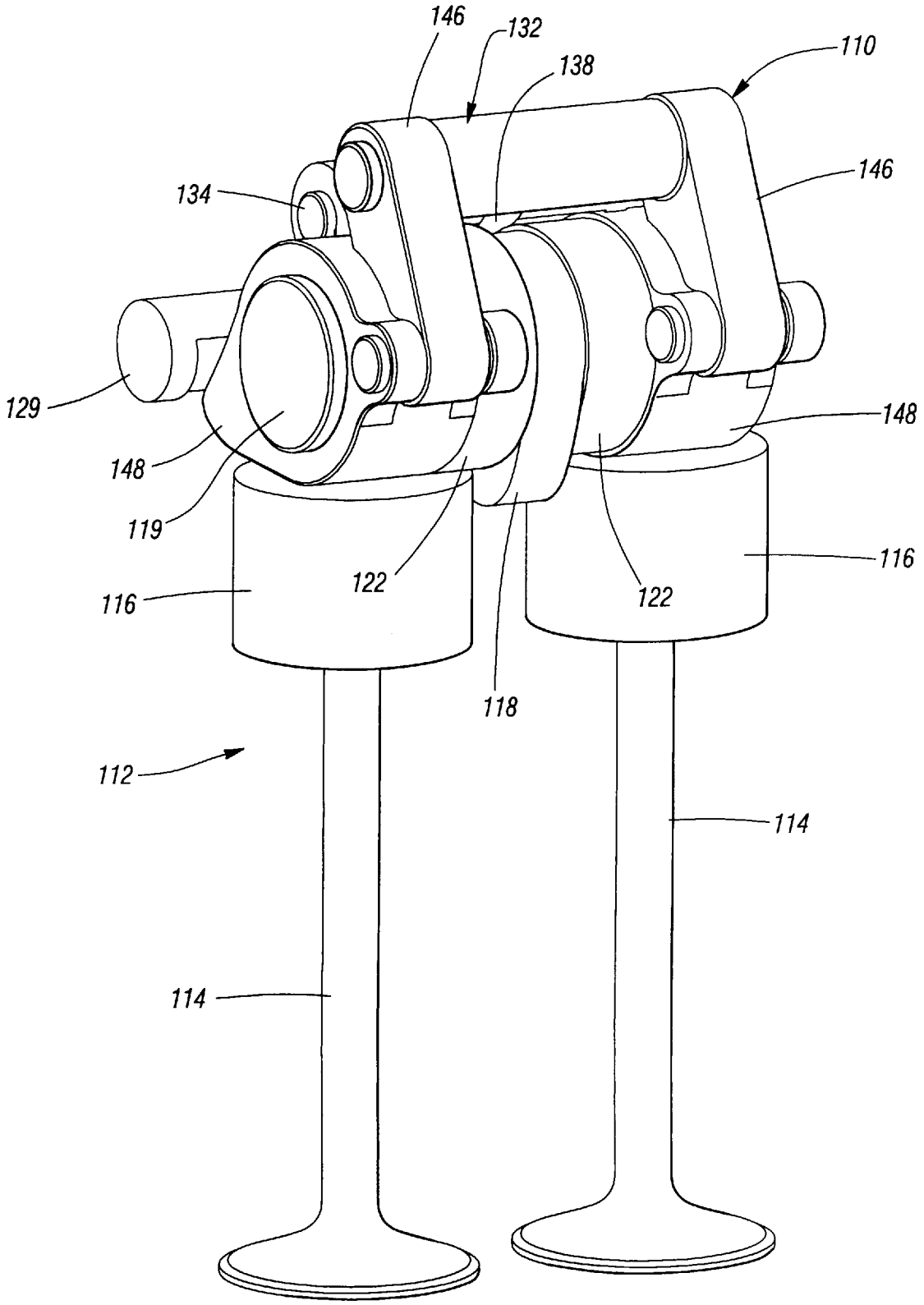

In all of FIGS. 2–5, the control members 122 are shown in their "first" positions wherein the valves are fully opened and closed each cycle of the mechanism. As before, the control members 122 may be moved (counterclockwise as shown in FIGS. 2 and 3) toward second positions wherein the dual valves 114 have reduced lift or remain closed while the mechanism cycles. Further description of the structure and operation of this second embodiment is deemed unnecessary in view of its similarities to the first embodiment of FIG. 1.

Figure 6:
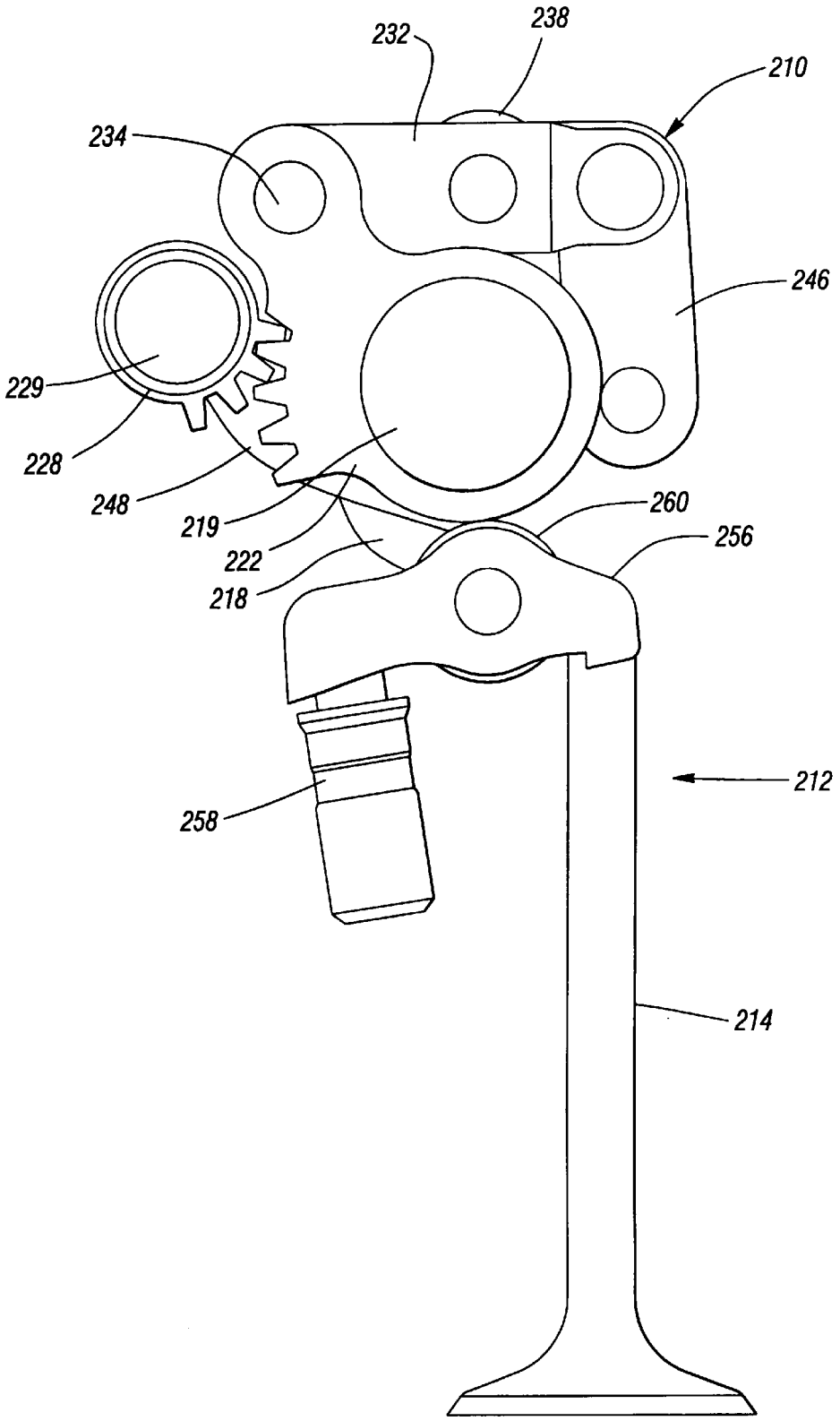
FIG. 6 is an end view of an alternative mechanism according to the invention actuating a valve through a roller finger follower.
Figure 7:
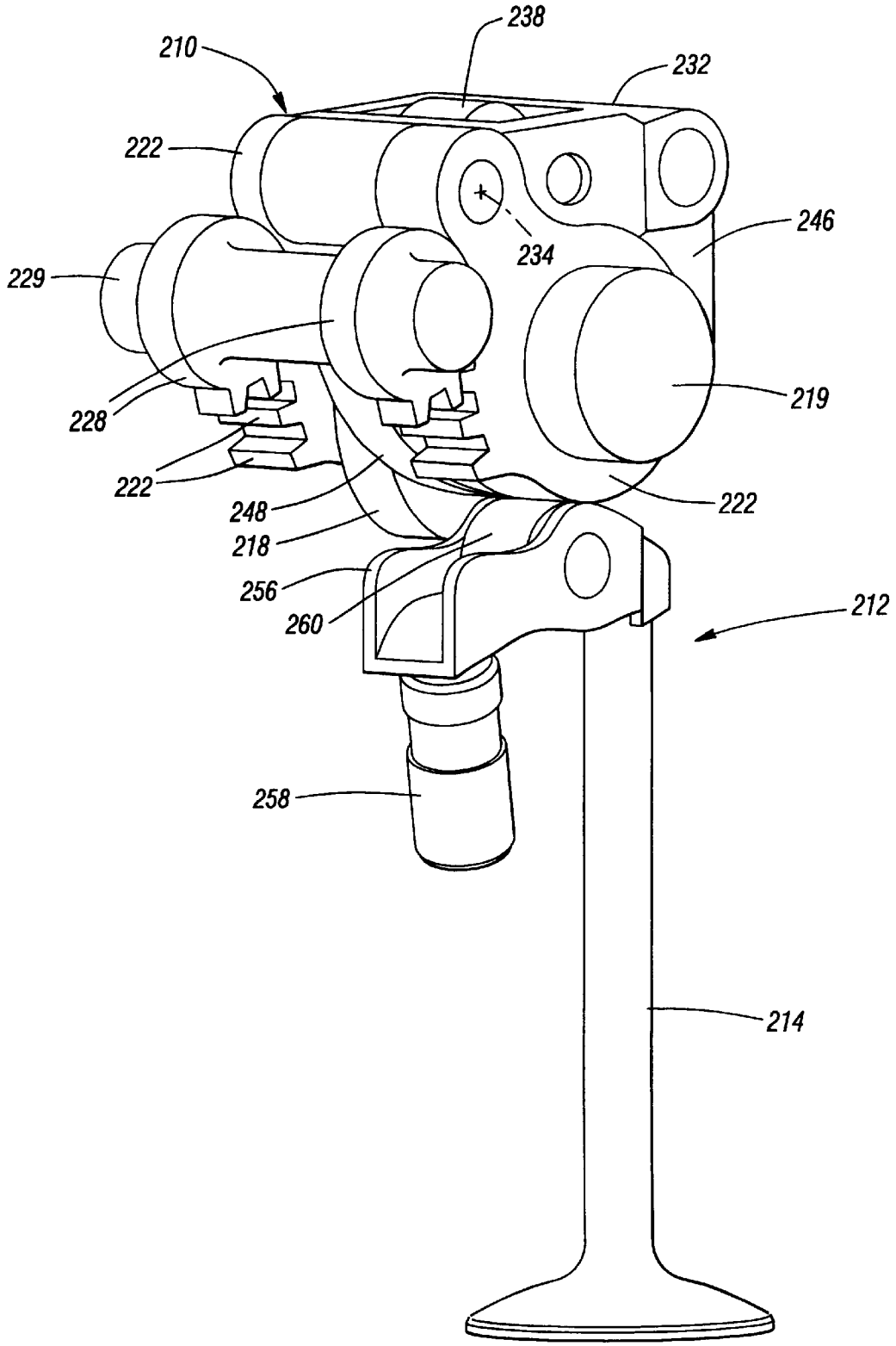
FIGS. 7 and 8 are isometric front and rear views of the mechanism of FIG. 6.
Figure 8:
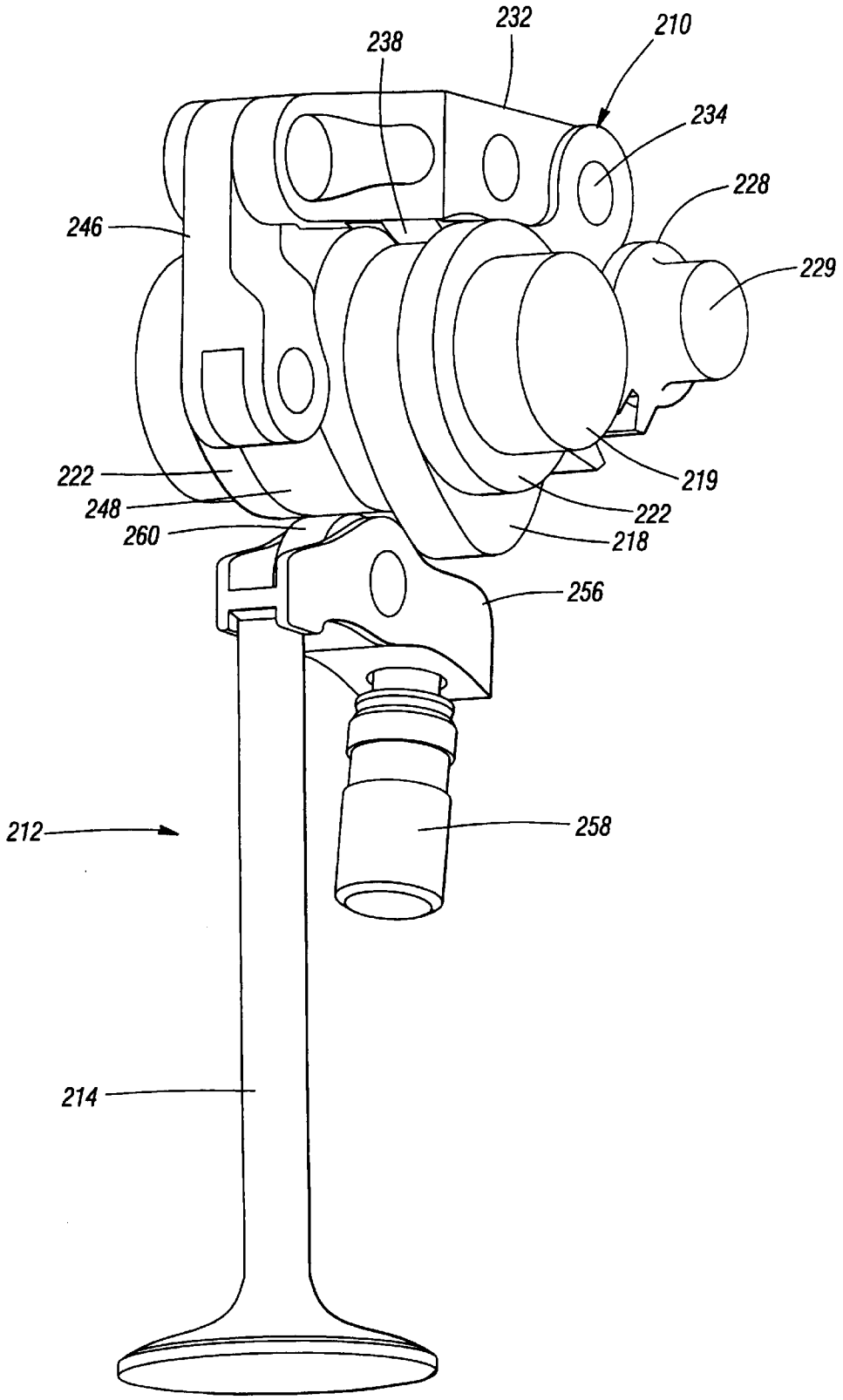

FIGS. 6–8 show an alternative third embodiment of VVT mechanism 210 in an engine 212 wherein similar components have similar suffixes in the 200 series of numerals. Mechanism 210 differs from the second embodiment 110 of FIGS. 2–5 primarily in that, rather than engaging direct acting followers, the mechanism 210 is arranged in the engine 212 to operate a single valve 214 driven by a fmger follower 256 with one end contacting a single valve 214 and another end pivotally supported by a stationary lash adjuster 258. A follower roller 260 is carried by the follower 256 and engages an oscillating cam 248.

In the mechanism 210, dual control members 222 are positioned by control gears 228 mounted on a common control shaft 229. In the illustrated third embodiment, as before, the dual control members 222 define the pivot axis 234 for the primary lever or rocker 232. A single rotary cam 218 carried on a camshaft 219 drives a single roller follower 238 in the rocker 232 to lift a single link 246 that oscillates the cam 248.

FIGS. 6–8 show the mechanism 210 with the single valve 214 closed but with the dual control members 222 positioned to fully open the valve 214 upon oscillation of the cam 248. Clockwise rotation of the control members 222 by the control gears 228, as seen in FIG. 6, would reduce or prevent valve lift as the base circle portion of the oscillating cam 248 increasingly contacts the finger follower roller 260 during cam oscillation. Further description of the structure and operation of this third embodiment is deemed unnecessary in view of its similarities to the previously described embodiments.

It is noted that the three embodiments so far described all have the primary lever or rocker members 32, 132, 232 located generally in the upper portion of the mechanism. In these arrangements, this places the rockers generally on the side opposite from the valve or valves and their valve actuating members 16, 116, 256. The various elements may be varied in size, shape and location in order to obtain the required valve motion and the compactness of the mechanism to allow its positioning in the available space within the engine. Considerable flexibility is possible in positioning the rockers relative to the valves as will be seen in the following example comprising a fourth embodiment of the invention.

Figure 9:
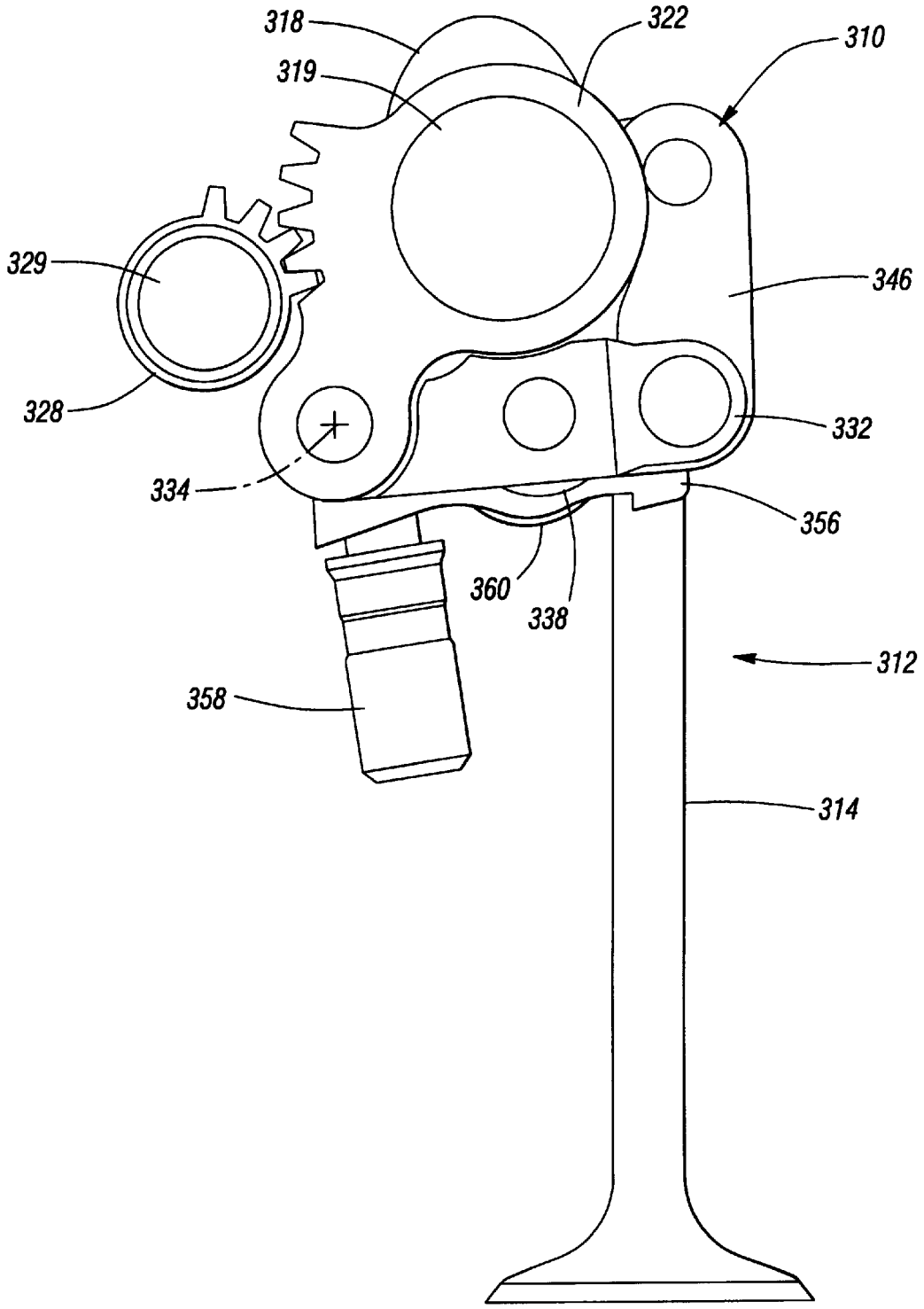
FIG. 9 is an end view of another alternative mechanism actuating a valve through a finger follower.
Figure 10:
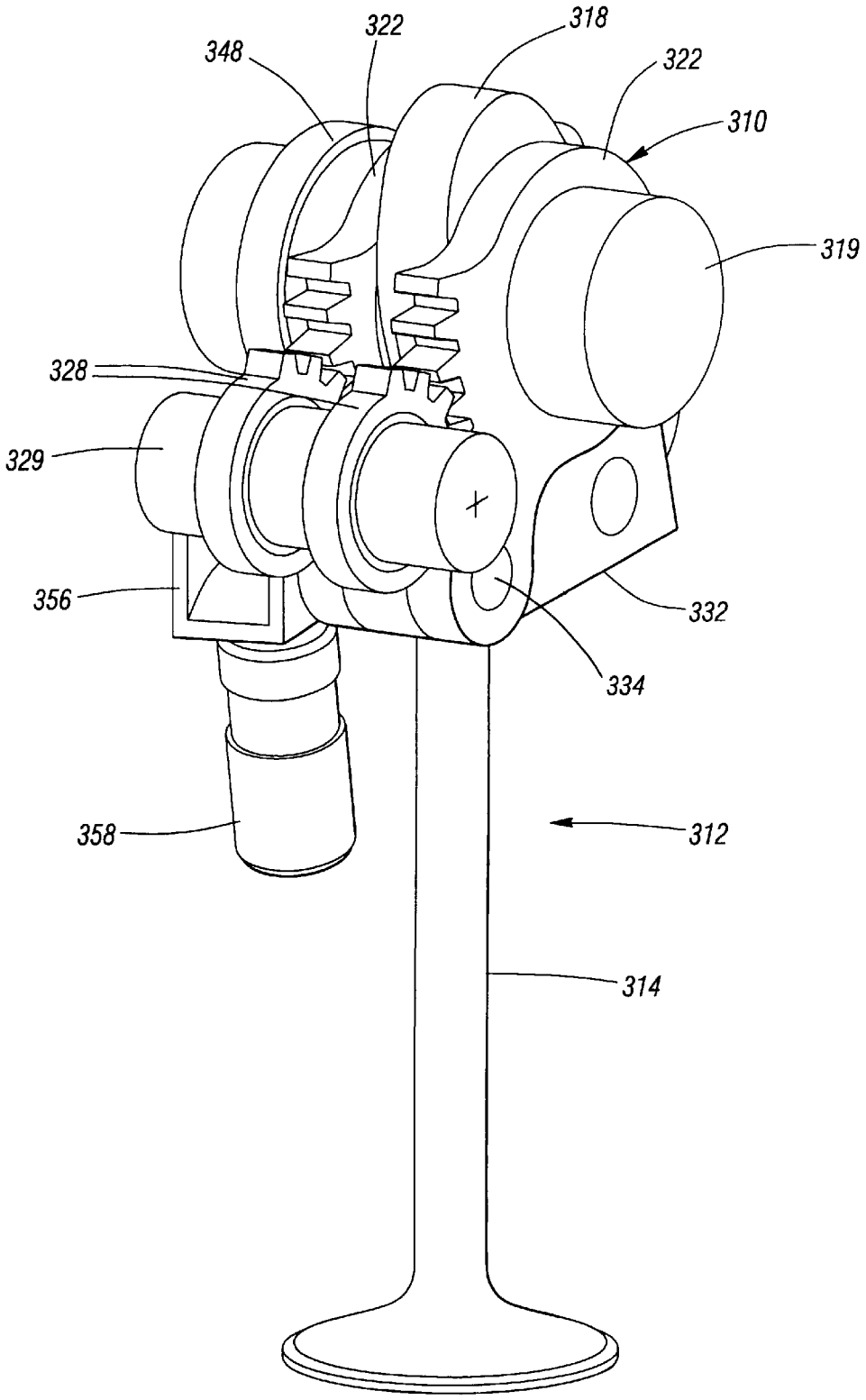
FIGS. 10 and 11 are isometric front and rear views of the mechanism of FIG. 9.
Figure 11:
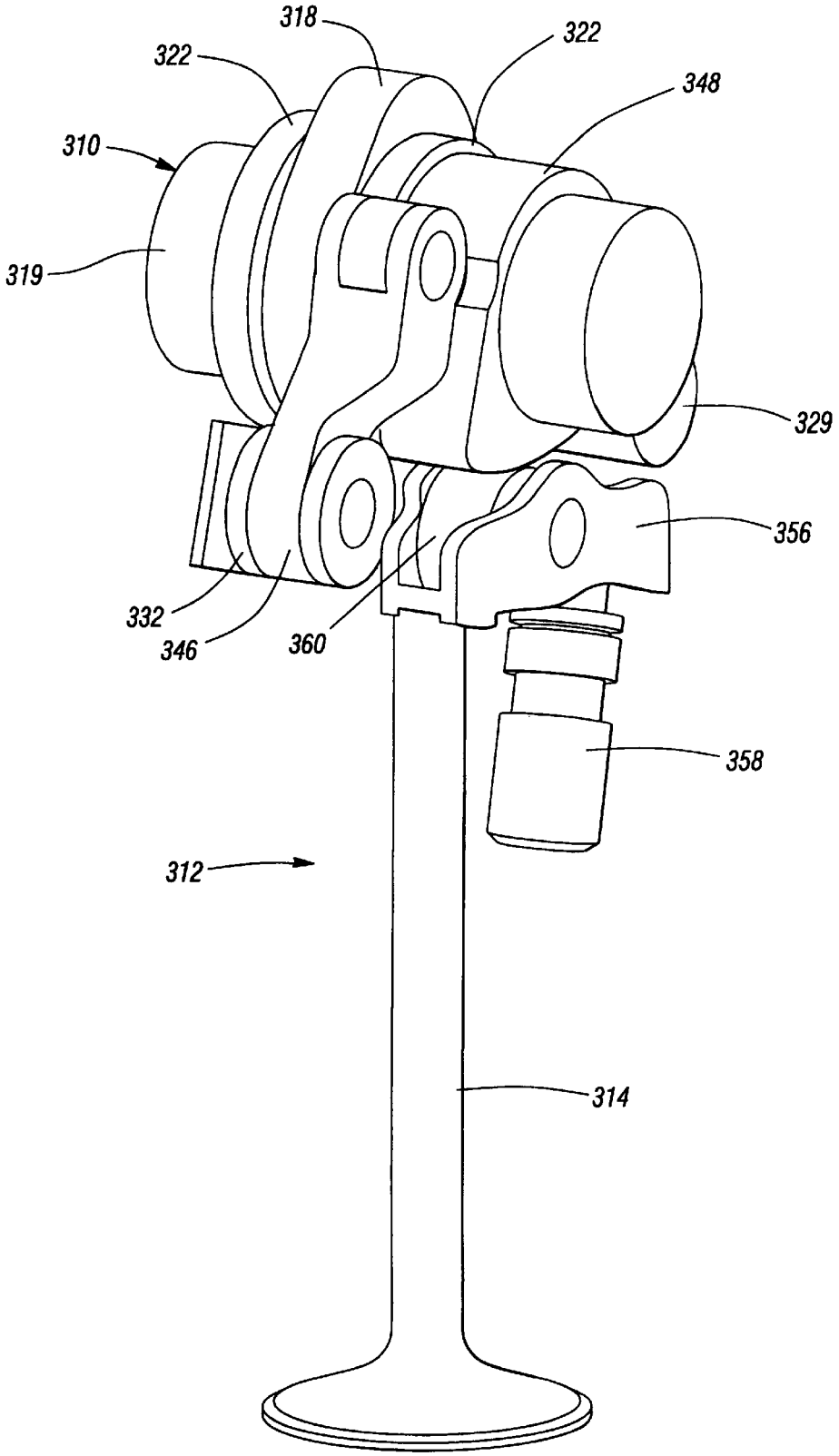

FIGS. 9–11 disclose this alternative fourth embodiment of an VVT mechanism 310 wherein reference numerals in the 300 series are used with components similar to those previously described having common suffixes. Mechanism 310 is similar to the third embodiment 210 of FIGS. 6–8 in that the mechanism is arranged in an engine 312 to operate a single valve 314 driven by a finger follower 356 with one end contacting the valve 314 and another end pivotally supported by a stationary lash adjuster 358. A follower roller 360 is carried by the finger follower 356 and engages an oscillating cam 348.

In the mechanism 310, dual control members 322 are positioned by control gears 328 mounted on a common control shaft 329. In the illustrated fourth embodiment, as before, the dual control members 322 define the pivot axis 334 for the primary lever or rocker 332. A single rotary cam 318 carried on a camshaft 319 drives a single roller follower 338 in the rocker 332 to pull downward a single link 346 that oscillates the cam 348.

A prime difference of this fourth embodiment from those previously described is that the linkage is repositioned so that the rocker 332 is located on the same side of the camshaft 319 or cam 318 as is the valve 314 and the valve actuator, finger follower 356. As shown, the rocker 332 is actually positioned adjacent to the finger follower 356 which contacts the upper end of the valve 314. This provides the potential for even greater compactness in engine valve arrangements which will allow such placement of the rocker.

FIGS. 9–11 show the mechanism 310 with the valve 314 closed but with the dual control members 322 positioned to fully open the valve 314 upon oscillation of the cam 348. Counterclockwise rotation of the control members 322, as seen in FIG. 9, by the control gears 328 will reduce or prevent valve lift as the base circle portion of the oscillating cam 348 increasingly contacts the finger follower roller 360 during cam oscillation. Further description of the structure and operation of this fourth embodiment is deemed unnecessary in view of its similarities to the previously described embodiments.

Figure 12:
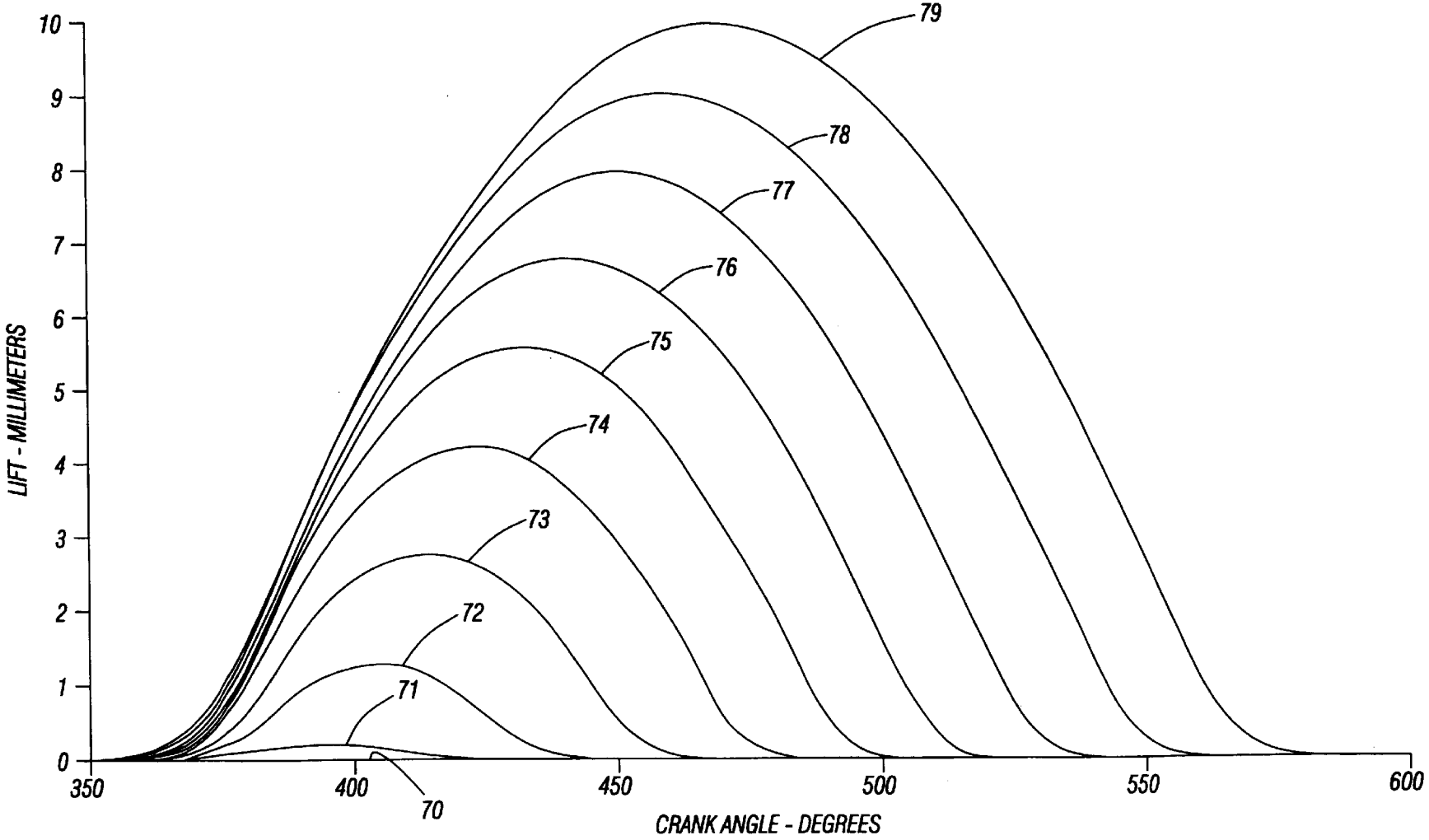
FIG. 12 is a graph illustrating exemplary valve timing and lift curves potentially obtainable with the mechanisms of FIGS. 1–11.

Referring now to FIG. 12, there is shown a graphical illustration of one possible family of valve timing and lift curves which could be obtained with VVT mechanisms of the sort discussed above. In the figure, curves 70–79 indicate valve lifts from "no lift" 70 to "full lift" 79 with full valve open time. Intermediate curves 71–78 represent intermediate valve lifts and open periods ranging from only slightly open to nearly fully open. The actual curves for any particular linkage arrangement would be dependent on its dimensional characteristics as determined during development of the particular mechanism and its application in an engine.

As used in the claims, the term "eccentric" is intended to include cam, crank, and other eccentric drive elements. Thus, an eccentric follower may be a cam follower or, for example, a connecting rod attached to a crank. Other examples will be obvious to those skilled in the art.

It should be understood that the previously described embodiments of the invention are only representative of numerous alternatives which may be envisioned in applying the invention. For example, the mechanisms could be used to actuate a pushrod or other device as a valve actuator instead of a finger follower or a direct acting follower. Also, the control gear arrangement could be replaced by any other suitable mechanism, such as an eccentric or cam or a control lever and link. Further, when the VVT mechanisms are used to actuate multiple valves, the timing and/or lift of the valves may have different values. This could be accomplished by providing a separate rotary eccentric or cam for each valve with different lift curves for each valve. Alternatively, the oscillating cams which drive the valve actuators may have differing lift curves to vary the lift or timing of valve opening.

The torsion springs 54, 56 shown in FIG. 1 are only representative of numerous forms of springs which could be used to return the VVT mechanism to its valve closed position in operating conditions where the force of the conventional valve spring is not effective for this purpose. Such springs or other means would likely be required with all the mechanisms disclosed although they are not illustrated in the other drawing figures.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

We claim:

1. Valve actuating mechanism comprising:

a rotary eccentric rotatable about a primary axis;

a control member pivotable about said primary axis and including a first pivot axis spaced from said primary axis;

a primary lever connected with said control member and pivotable about said first pivot axis, said primary lever having a distal end and an eccentric follower operatively connected intermediate said distal end and the first pivot axis, said eccentric follower operatively engaging said rotary eccentric; and a secondary lever having one end pivotable about said primary axis, said one end including an oscillating cam engaging a valve actuating member and having a base circle portion and a valve lift portion, the secondary lever having a distal end operatively connected with the distal end of said primary lever, said control member being movable between a first angular position wherein primarily the valve lift portion of said oscillating cam engages the valve actuating member for fully opening and closing an associated valve and a second angular position wherein primarily the base circle portion of said oscillating cam engages the valve actuating member for providing minimal opening and closing movement of said associated valve.

2. Valve actuating mechanism as in claim 1 wherein said rotary eccentric is a cam and the eccentric follower is a cam follower.

3. Valve actuating mechanism as in claim 2 wherein said cam follower is a roller follower.

4. Valve actuating mechanism as in claim 1 wherein the operative connection of the primary and secondary levers is through a link connected between the distal ends of said levers.

5. Valve actuating mechanism as in claim 1 wherein said valve actuating member is a direct acting cam follower.

6. Valve actuating mechanism as in claim 1 wherein said valve actuating member is a fmger follower.

7. Valve actuating mechanism as in claim 1 wherein said control member is pivotally actuated by a toothed control gear engaging mating teeth on the control member.

8. Valve actuating mechanism as in claim 1 wherein said rotary eccentric is a rotary cam, the eccentric follower is a cam follower and the cam follower engages the rotary cam on a side generally opposite to the location of the valve actuating member.

9. Valve actuating mechanism as in claim 1 wherein said rotary eccentric is a rotary cam, the eccentric follower is a cam follower and the cam follower engages the rotary cam on a side generally adjacent to the location of the valve actuating member.

10. Valve actuating mechanism comprising:

a rotary cam rotatable about a primary axis;

a control member pivotable about said primary axis and including a first pivot axis spaced from said primary axis;

a primary lever connected with said control member and pivotable about said first pivot axis, said primary lever having a distal end and a cam follower operatively connected intermediate said distal end and the first pivot axis, said cam follower operatively engaging said rotary cam; and a secondary lever having one end pivotable about said primary axis, said one end including an oscillating cam engaging a valve actuating member and having a base circle portion and a valve lift portion, the secondary lever having a distal end operatively connected with the distal end of said primary lever, said control member being movable between a first angular position wherein primarily the valve lift portion of said oscillating cam engages the valve actuating member for fully opening and closing an associated valve and a second angular position wherein primarily the base circle portion of said oscillating cam engages the valve actuating member for providing minimal opening and closing movement of said associated valve.

11. Valve actuating mechanism as in claim 10 wherein said valve actuating member is a direct acting cam follower linearly movable with an associated valve and directly engaged by said oscillating cam.

12. Valve actuating mechanism as in claim 10 wherein said valve actuating member is a pivotable finger follower engaging an associated valve and engaged by said oscillating cam for actuating the valve.

13. Valve actuating mechanism as in claim 10 wherein the cam follower engages the rotary cam on a side generally opposite to the location of the valve actuating member.

14. Valve actuating mechanism as in claim 10 wherein the cam follower engages the rotary cam on a side generally adjacent to the location of the valve actuating member.

* * * * *